US008448878B2

(12) United States Patent
Ibrahim et al.

(10) Patent No.: US 8,448,878 B2
(45) Date of Patent: May 28, 2013

(54) FUEL INJECTOR WITH NEEDLE CONTROL SYSTEM THAT INCLUDES F, A, Z AND E ORIFICES

(75) Inventors: Daniel Richard Ibrahim, Metamora, IL (US); Bryan David Moore, Washington, IL (US); Christopher D. Hanson, Secor, IL (US); Avinash Reddy Manubolu, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 334 days.

(21) Appl. No.: 12/941,355

(22) Filed: Nov. 8, 2010

(65) Prior Publication Data

US 2012/0111965 A1 May 10, 2012

(51) Int. Cl.

| | |
|---|---|
| ***F02M 47/02*** | (2006.01) |
| ***F02M 51/06*** | (2006.01) |
| ***F02M 51/00*** | (2006.01) |

(52) U.S. Cl.

USPC ..... 239/5; 239/88; 239/533.8; 239/585.1

(58) Field of Classification Search

USPC ..... 239/5, 88, 96, 533.2, 533.8, 533.9, 239/533.11, 585.1; 123/445–447, 472, 478, 123/490

See application file for complete search history.

(56) References Cited

U.S. PATENT DOCUMENTS

| | | | | |
|---|---|---|---|---|
| 5,671,715 | A | 9/1997 | Tsuzuki | |
| 5,722,600 | A | 3/1998 | Horiuchi | |
| 6,789,753 | B2 * | 9/2004 | Aoki et al. | 239/533.2 |
| 6,814,302 | B2 | 11/2004 | Stoecklein et al. | |
| 6,880,766 | B2 * | 4/2005 | Lewis et al. | 239/88 |
| 6,907,864 | B2 * | 6/2005 | Takemoto | 123/478 |
| 6,986,474 | B2 | 1/2006 | Bloching et al. | |
| 6,997,166 | B2 | 2/2006 | Stringfellow | |
| 7,331,329 | B2 | 2/2008 | Tian et al. | |
| 2005/0045150 | A1 * | 3/2005 | Furukubo et al. | 123/447 |
| 2005/0194463 | A1 * | 9/2005 | Boecking | 239/96 |
| 2005/0242211 | A1 | 11/2005 | Funai et al. | |
| 2006/0086818 | A1 | 4/2006 | Boecking | |
| 2006/0097067 | A1 * | 5/2006 | Buehler et al. | 239/88 |
| 2006/0151636 | A1 | 7/2006 | Harcombe et al. | |
| 2008/0257980 | A1 * | 10/2008 | Magel | 239/89 |
| 2009/0101112 | A1 | 4/2009 | Kim et al. | |
| 2009/0145404 | A1 * | 6/2009 | Heinz et al. | 123/456 |
| 2009/0314860 | A1 * | 12/2009 | Wang et al. | 239/585.1 |

FOREIGN PATENT DOCUMENTS

| | | |
|---|---|---|
| DE | 4406901 | 3/1998 |
| EP | 1236886 | 9/2002 |
| WO | 2005045233 | 5/2005 |
| WO | 03004862 | 1/2012 |

* cited by examiner

*Primary Examiner* — Darren W Gorman
(74) *Attorney, Agent, or Firm* — Liell & McNeil

(57) ABSTRACT

A common rail fuel injector includes a needle valve member that moves to open and close nozzle outlets for a fuel injection event responsive to pressure in a needle control chamber. Between injection events, the needle control chamber is fluidly connected to the fuel inlet by a first pathway that includes a Z orifice, and fluidly connected to the fuel inlet by a second pathway that includes an F orifice, an intermediate chamber and an A orifice. During an injection event, the needle control chamber is fluidly connected to a drain outlet by a third pathway that includes the A orifice, the intermediate chamber and an E orifice. Different performance characteristics are achieved by adjusting the sizes of the respective of F, A, Z and E orifices.

20 Claims, 5 Drawing Sheets

F Orifice

A Orifice

E Orifice

FUEL INJECTOR WITH NEEDLE CONTROL SYSTEM THAT INCLUDES F, A, Z AND E ORIFICES

TECHNICAL FIELD

The present disclosure relates generally to direct control needle valves for fuel injectors, and more particularly to a needle control system that includes variously sized F, A, Z and E orifices.

BACKGROUND

Today's electronically controlled compression ignition engines typically include an electronically controlled fuel injector with a direct operated check valve. The direct operated check valve includes a closing hydraulic surface exposed to pressure in a needle control chamber. Pressure is relieved in the needle control chamber to initiate an injection event by actuating a two way or three way valve to fluidly connect the needle control chamber to a low pressure drain outlet. The injection event is ended by de-energizing the electronically controlled two way or three way valve to repressurize the needle control chamber. Co-owned U.S. Pat. No. 7,331,329 shows an example of such a fuel injector with a three way valve, whereas U.S. Pat. No. 6,986,474 shows an example fuel injector with a two way valve. In general, a three way valve version can provide greater performance capabilities relative to a two way valve counterpart, but does so at the expense of increased complexity and difficultly to manufacture, especially mass producing fuel injectors with consistent performance behaviors.

Early versions of the two way valve typically included the needle control chamber fluidly connected to a nozzle supply passage via an unobstructed Z orifice, and the two way valve permitted fluid communication between the needle control chamber and a low pressure drain outlet through a so called A orifice. During an injection event, the nozzle supply passage is fluidly connected directly to the low pressure drain via the Z orifice, the needle control chamber and the A orifice. Thus there was an initial motivation to make the A and Z orifices relatively small in order to reduce losses during an injection event. This motivation quickly lead to a problem associated with a general desirability to end injection events abruptly, which is accomplished by quickly raising pressure in the needle control chamber. A small Z orifice slows the rate at which pressure may grow in the needle control chamber at the end of an injection event. This problem was addressed by adding an additional orifice to facilitate the quick repressurization in the needle control chamber toward the end of injection event. For instance, previously identified U.S. Pat. No. 6,986,474 includes an additional orifice 14 that facilitates repressurization of its needle control chamber 4 via both the Z orifice 5 as well as through the A orifice 6 by way of the additional fill or F orifice 14. The three way valve fuel injector counterpart identified above in co-owned U.S. Pat. No. 7,331,329 likewise includes three orifices, which include a Z orifice 112, and two other orifices 110 and 111, that most closely resemble in performance the F orifice and A orifice, respectively for the counterpart two way valve fuel injector.

Because of the complexity and difficulty in manufacturing a three way valve that performs consistently with mass produced fuel injectors, there is a growing desire toward utilizing a two way control valve to perform the pressure control function in a direct control check valve for a fuel injector. Unfortunately, current strategies with regard to utilization of two way valves, even with the inclusion of F, A and Z orifices, result in less than satisfactory performance relative to the counterpart three way valve control strategy. For instance, while the inclusion of an F orifice can aid in hastening the end of an injection event, the F orifice may not assist in retarding the rate at which the needle valve member opens to commence an injection event, which is also sometimes a desirable fuel injector attribute. In addition, variations in flow areas among control valves for mass produced fuel injectors can result in an unacceptable variance in performance among the fuel injectors.

The present disclosure is directed to one or more of the problems set forth above.

SUMMARY OF THE DISCLOSURE

In one aspect, a fuel injector includes an injector body that defines a fuel inlet, at least one nozzle outlet and a drain outlet, and has disposed therein a nozzle chamber, a needle control chamber and an intermediate chamber. The needle control chamber is fluidly connected to the fuel inlet by a first pathway that includes a Z orifice, and the needle control chamber is fluidly connected to the fuel inlet by a second pathway that includes an F orifice, the intermediate chamber and an A orifice. An electronically controlled valve is attached to the injector body and includes a control valve member movable between a first position in contact with a seat and a second position out of contact with the seat. The needle control chamber is fluidly connected to a drain outlet by a third pathway that includes the A orifice, the intermediate chamber and an E orifice when the control valve member is at the second position, but the needle control chamber is blocked from the drain outlet when the control valve member is at the first position. A needle valve member includes an opening hydraulic surface exposed to fluid pressure in the nozzle chamber, and a closing hydraulic surface exposed to fluid pressure in the needle control chamber.

In another aspect, a method of operating the fuel injector includes starting an injection event by moving fuel from the needle control chamber through the A orifice, and from the nozzle chamber through the F orifice, toward the intermediate chamber. In addition, the injection event is started by moving fuel from the intermediate chamber toward the drain outlet through the E orifice. Afterwards, the injection event is ended.

DETAILED DESCRIPTION

Figure 1:
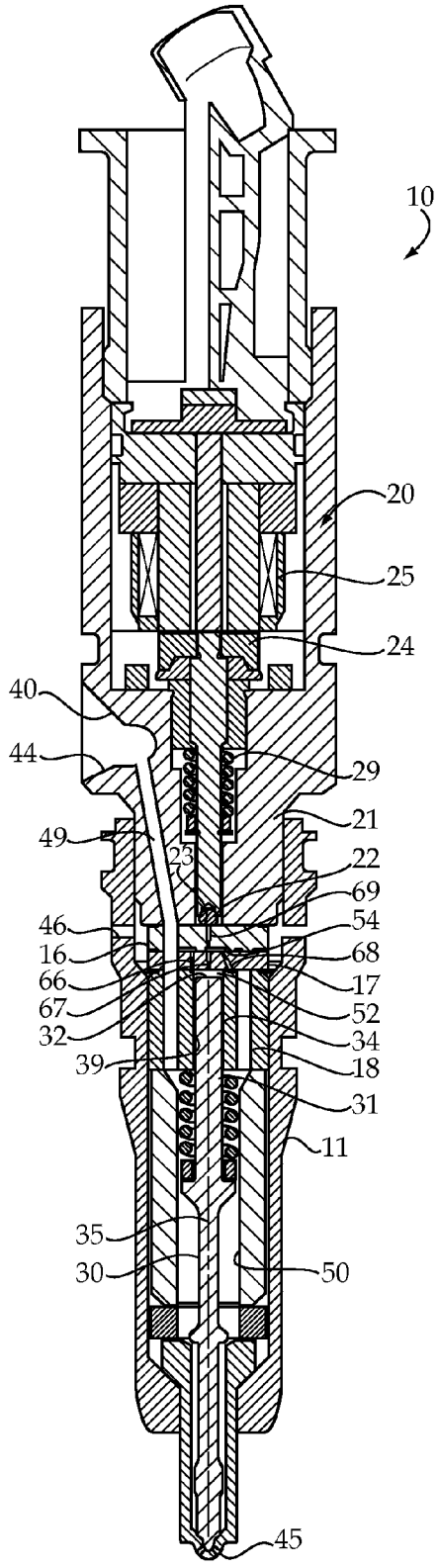
FIG. 1 is a sectioned side view of a fuel injector according to the present disclosure.
Figure 2:
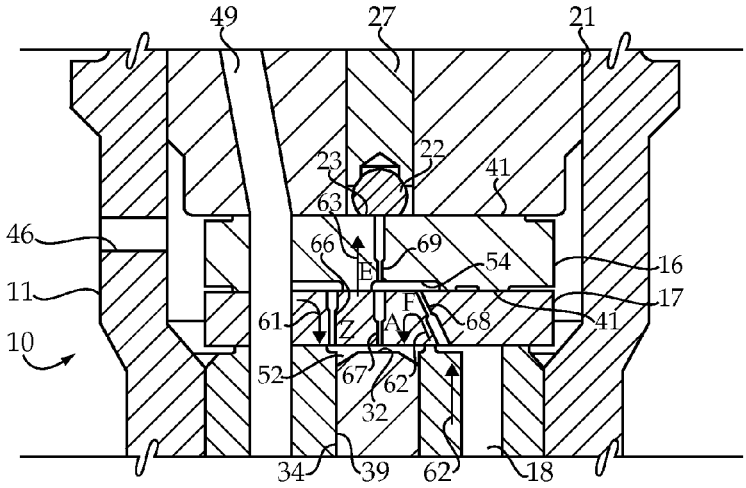
FIG. 2 is an enlarged sectioned view of the pressure control portion of the fuel injector shown in FIG. 1.

Referring to FIGS. 1 and 2, a fuel injector 10 includes an injector body that defines a fuel inlet 44, at least one nozzle outlet 45 and a low pressure drain outlet 46. Fuel inlet 44 includes a conical seat 40 to facilitate connection between fuel injector 10 and a common rail via a quill of a type well known in the art. Low pressure drain outlet 46 would be fluidly connected to tank to return for recirculation any fuel expended for the control function and/or from leakage. The nozzle outlets 45 would be positioned in the combustion space of a compression ignition engine to facilitate direct fuel injection into the engine cylinder. Fuel injector 10 includes a direct operated check 13 of a type briefly described in the background section. Disposed within injector body 11, which includes all hardware except electrical and moving components, are a number of fluid passageways and chambers. Among these are a nozzle chamber 50, a needle control chamber 52 and an intermediate chamber 54. As used in this disclosure, the term "injector body" means various stationary components of fuel injector 10 that define fluid passageways, chambers and the like. In the illustrated embodiment, nozzle chamber 50 is fluidly connected to fuel inlet 44 via an unobstructed nozzle supply passage 49 as is conventional in a common rail fuel injector. The term "unobstructed" means a fluid passage without valves or the like that change a flow area through the passage or possibly even block fluid flow through the same. Although the present disclosure is illustrated in the context of a common rail fuel injector 10, the principles surrounding the direct operated check 13 to be discussed infra could be equally applicable to other types of fuel injectors, including but not limited to, cam actuated fuel injectors, and may be hybrid common rail cam actuated fuel injectors.

Referring especially to FIG. 2, the needle control chamber 52 is fluidly connected to the fuel inlet 44 by a first pathway 61 that includes a Z orifice 66 and a segment of nozzle supply passage 49. As used in this disclosure, the term "orifice" means a flow restriction defined by a cylindrical passage with a uniform diameter and hence flow area. Thus, those skilled in the art will appreciate that flow restrictions may appear elsewhere in a fuel injector, such as at a clearance between a valve member and a valve seat, but such flow restrictions would not be considered orifices in the context of the present disclosure. The needle control chamber 52 is also fluidly connected to the fuel inlet 44 by a second pathway 62 that includes an F orifice 68, the intermediate chamber 54, A orifice 67 as well as nozzle chamber 50 and nozzle supply passage 49.

An electronically controlled valve 20 is attached to the injector body 11 and includes a control valve member 22 movable between a first position in contact with a seat 23, and a second position out of contact with the seat 23. In the illustrated embodiment, the electronically control valve 20 includes a solenoid with an armature 24 that is attached to a pusher 27 in contact with control valve member 22. Thus, in the illustrated embodiment electrical actuator 25 is a solenoid, but could be another electrical actuator, such as a piezo, without departing from the present disclosure. In addition, control valve member 22 is shown movable into and out of contact with a seat 23, which is a flat seat, but could be a counterpart conical seat without departing from the present disclosure. Finally, although fuel injector 10 includes only one electrical actuator 25, the present disclosure could find potential application in fuel injectors with two or more electrical actuators, such as, for instance, a first electrical actuator associated with a spill valve and a second electrical actuator associated with a direct operated check as might be typical in the case of a cam actuated fuel injector. A spring 29 normally biases pusher 27 and control valve member 22 downward into contact with flat seat 23. The term "flat seat" means a valve seat that is part of a planar surface, and thus a flat seat is something different from a conical seat associated with a poppet valve or an edge seat associated with a spool valve.

The needle control chamber 52 is fluidly connected to the low pressure drain outlet 46 by a third pathway 63 that includes the A orifice 67, the intermediate chamber 54, an E orifice 69 and a low pressure clearance space between valve body 21 and a first orifice disk 16 when the control valve member is at the second position. In other words, the fluid connection between needle control chamber 52 and low pressure drain outlet 46 only occurs when control valve member 22 is out of contact with flat seat 23. Needle control chamber 52 is therefore blocked from low pressure drain outlet 46 when the control valve member 22 is at its first position with control valve member in contact with flat seat 23.

A needle valve member 30 is positioned in injector body 11 and movable between a first position in which nozzle outlets 45 are blocked from nozzle chamber 50, and a second raised position in which nozzle chamber 50 is fluidly connected to nozzle outlets 45 for an injection event. The needle valve member 30 includes an opening hydraulic surface 31 exposed to fluid pressure in nozzle chamber 50, and a closing hydraulic surface 32 exposed to fluid pressure in needle control chamber 52. A centerline 35 of needle valve member 30 intersects an opening of the third pathway 63 into needle control chamber 52. This structure creates a so called hydraulic stop when the needle valve member 30 is in its upward open position, which is to be contrasted with a mechanical stop in which a valve member actually comes in contact with a stop surface when in its open position. In the case of a hydraulic stop, the needle valve member 30 with hover just out of contact with the lower surface of second orifice disk 17 during an injection event. The hydraulic stop strategy has the advantage of rendering the needle valve member more responsive than an equivalent counterpart with identical features except a mechanical stop. Nevertheless, the teachings of the present disclosure also find potential applicability to needle valve members that contact a mechanical stop in its open position. Needle controlled chamber 52 is separated from nozzle chamber 50 by a guide segment 34 of needle valve member 30 that is guided in its movement via a guide bore 39 defined by needle guide component 18.

Figure 3:
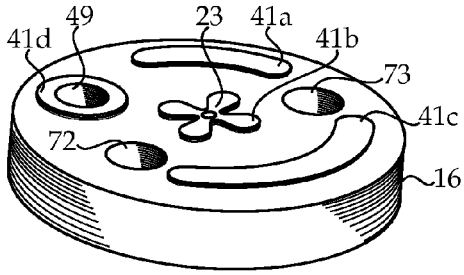
FIG. 3 is a perspective top view of a first orifice disk according to one aspect of the present disclosure.
Figure 4:
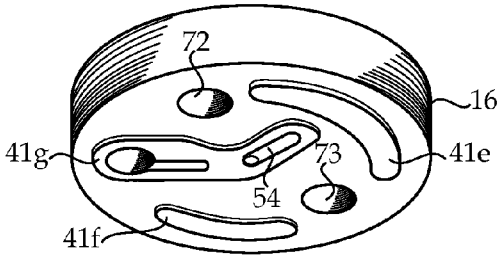
FIG. 4 is a bottom perspective view of the first orifice disk of FIG. 3.
Figure 5:
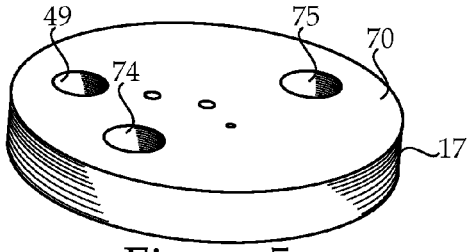
FIG. 5 is a perspective top view of a second orifice disk according to another aspect of the present disclosure.

Referring in addition to FIGS. 3-5, the E orifice 69 may be defined by the first disk 16 that is stacked between valve body 21 and the second orifice disk 17. In particular, first orifice disk 16 contacts valve body 21 over a plurality of non contiguous sealing lands 41*a-d* (FIG. 3) that are defined by raised surfaces. Thus, the third pathway 63 discussed earlier includes the flow area between the control valve member 22 and flat seat 23, as well as the open space between the raised surface sealing lands 41*a-d*. Those skilled in the art will recognize that each high pressure passageway, such as nozzle supply passage 49 is completely surrounded by a sealing land 41*d* in a manner similar to the sealing land 41*b* that completely surrounds and defines a portion of flat seat 23. By utilizing raised sealing lands, less clamping pressure may be necessary in the fuel injector in order to inhibit leakage between components of the injector stack, which is a portion of the injector body 11. Thus, the injector body includes valve body 21, first orifice disk 16, second orifice disk 17 and needle guide component 18. First orifice disk 16 also includes on its underside a plurality of non contiguous sealing lands 41*e-g* that contact with an upper planar surface 70 of second orifice disk 17. Second orifice disk 17 defines the F orifice, the A orifice and the Z orifice as best shown in FIG. 2. The intermediate chamber 54 is defined partly by first orifice disk 16 and partly by second orifice disk 17, also as best shown in FIG. 2. The orifice second disk 17 is stacked between first orifice disk 16 and needle guide component 18. As used in the present disclosure, the term "disk" means a relatively thin object that likely will have a circular cross section (as shown) but need not necessarily have a circular shaped cross section. The thinness of the object, in the case of first orifice disk 16 is defined by the non-contiguous sealing lands 41*a-d* on the top side and 41*e-g* on the bottom side, which lay in parallel planes. In the case of second orifice disk 17, both the upper and lower surfaces are planar. Those skilled in the art will appreciate that the non-contiguous sealing land strategy can be located elsewhere, such as the underside of valve body 21, or on one or both of the upper and lower surfaces of second orifice disk 17 without departing from the present disclosure. In addition, although the F, A, Z and E orifices are defined by disks in the fuel injector 10 of the present disclosure, those skilled in the art will appreciate that this need not necessarily be the case and a fuel injector according to the present disclosure could be made without inclusion of any disks. Disk 16 includes dowel holes 72 and 73 that should align with dowel holes 74 and 75 in disk 17 when fuel injector 10 is assembled so that the various passageways align with one another as best shown in FIG. 2.

When the electrical actuator 25 is energized to move valve member 22 out of contact with flat seat 23, the fluid connection between needle control chamber 52 and low pressure drain outlet 46 is facilitated for an injection event. In order to desensitize fuel injector performance to variations in control valve lift, the flow area through orifice E may be smaller than a flow area defined by flat seat 23 and control valve member 22 at the second or open position. Thus, one could expect some variance on control valve lift and hence the flow area between control valve member 22 and flat seat 23 in the mass production of fuel injectors, and also expect control valve lift to possibly grow with time as the fuel injector breaks in over time with many injection events. By sizing E orifice to be smaller than the flow area between flat seat 23 and control valve member 22, the performance of the fuel injector can be desensitized to variations in control valve lift as well as growth in control valve lift over time. Nevertheless, the flow area through orifice E could be larger than other flow restrictions in the third pathway 63 without departing from the present disclosure.

Although not necessary, the F, A, Z and E orifices may all have flow areas of a same order of magnitude. The phrase "same order of magnitude" means that the flow area through any orifice is not more than ten times the flow area through any of the other orifices. Depending upon the particular application, some experimentation may be necessary in order to arrive at a set of orifice flow areas that produce desired performance results across a fuel injector's operating range. For instance, a set of orifice flow areas that work well at one injection pressure may be undesirable or maybe even unacceptable at a different injection pressure. For instance, the best set of flow areas at high injection pressures may be incompatible with the operation of the same fuel injector at low injection pressures, such as at idle, and vice versa. Thus, the respective flow areas of the different orifices may be some compromise to produce acceptable performance from the fuel injector at all operating conditions, and thus one could expect some experimentation necessary to find a combination of orifice flow areas for a specific fuel injector application.

Industrial Applicability

The present disclosure finds generally applicability to any fuel injector with a direct operated check, including but not limited to common rail fuel injectors, cam actuated fuel injectors and hybrids. The present disclosure finds particular applicability to fuel injectors with direct operated checks that utilize a two way valve, but could find potential application in fuel injectors that utilize a three way valve. The present disclosure finds specific applicability to common rail fuel injectors that include a two way control valve. By appropriately choosing the flow areas for each of the different orifices, certain desirable performance characteristics can be achieved, including slowing the initial start of injection front end rate shape, as well as facilitating an abrupt end to any injection event.

Between injection events, electrical actuator 25 is de-energized and control valve member 22 is in its downward closed position in contact with flat seat 23 to block fluid communication between needle control chamber 52 and the low pressure drain outlet 46. High pressure, which should be about the same as the rail pressure, should prevail in nozzle supply passage 49, nozzle chamber 50, needle control chamber 52 and intermediate chamber 54 as well as the F, A, Z and E orifices. Those skilled in the art will appreciate that fuel injector 10 is free of locations where a low pressure space is separated from a high pressure space between injection events by a movable guide member surface. As such, fuel injector 10 can be expected to exhibit low static leakage.

Figure 6:
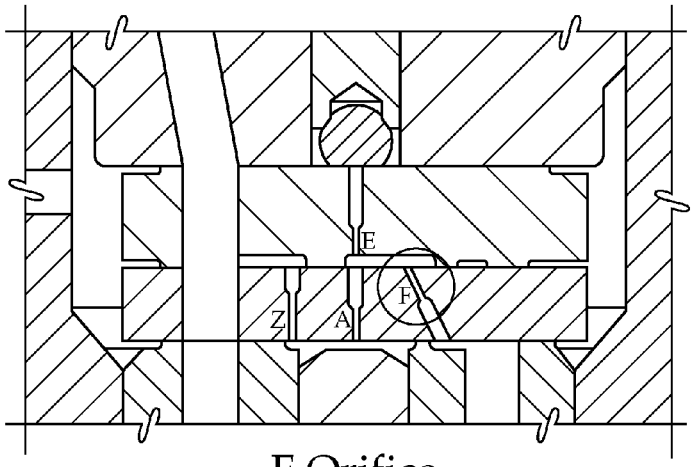
FIG. 6 is a series of strip charts for an injection event that includes actuator current, control valve motion, intermediate chamber pressure, needle control chamber pressure, needle valve member motion and injection rate, respectively, versus time with and without an F orifice.
Figure 6:
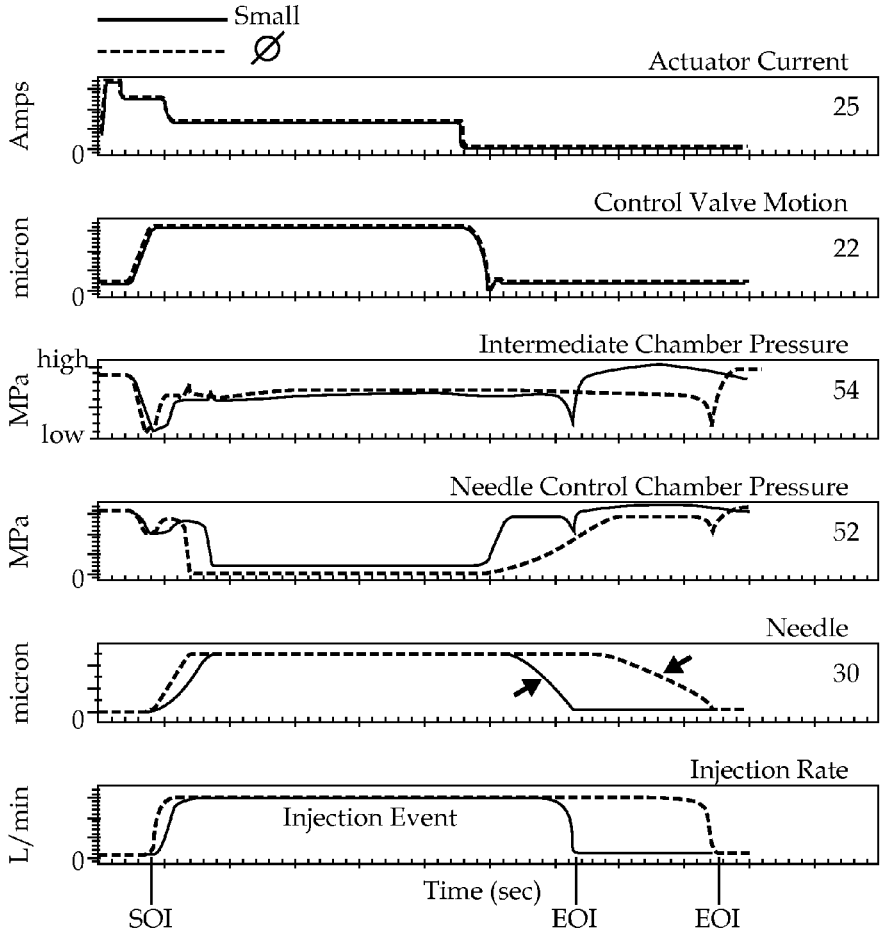

Each injection event is initiated by energizing electrical actuator 25 to move control valve member 22 out of contact with seat 23. In particular, and referring to the first two strip graphs of FIG. 6, electrical actuator 25 is initially energized to a pull in current, and then stepped down to a hold in current as control valve member 22 moves and becomes relatively stationary at its upward open position. When this occurs, fuel begins moving from needle control chamber 52 through A orifice 67, and at the same time from nozzle chamber 50 through F orifice 68 toward intermediate chamber 54. At the same time, fuel begins moving from intermediate chamber 54 toward low pressure drain outlet 46 through E orifice 69 and past valve member 22. This movement of fuel causes pressure to drop in needle control chamber 52 as shown in the fourth graph of FIG. 6 and to a lesser extent in intermediate chamber 54 as shown in the third graph of 56. When pressure drops sufficiently in needle control chamber 52, the upward opening hydraulic force on lifting hydraulic surface 31 overcomes the downward closing force from spring 29 and the closing hydraulic force on closing hydraulic surface 32 allowing needle valve member 30 to lift to its upward open position as shown in the fifth graph of FIG. 6 to commence the start of injection (SOI) as shown in the sixth graph of FIG. 6. The injection event is ended by de-energizing electrical actuator 25 and allowing valve member 22 to move downward into contact with seat 23 under the action of spring 29. This blocks further movement of fuel toward low pressure drain outlet 46 causing pressure to again rise in both needle control chamber 52 and intermediate chamber 54. When pressure and needle control chamber 52 exceeds the valve closing pressure sufficient to overcome the opening hydraulic force, needle valve member 30 moves downward to close the nozzle outlets 45 as shown in the fifth graph of FIG. 6 to facilitate the end of injection (EOI) as shown in the sixth graph of FIG. 6. The two different curves in FIG. 6 are included to illustrate how two different sized flow areas of the F orifice affect the abruptness of the end of injection. The dotted lines show when the F orifice has a zero flow area or is eliminated all together showing that a substantial delay occurs between the control valve member closing at its seat as shown in the second graph until the needle valve member 30 finally reaches its downward closed position for an end of injection as shown in the fifth and sixth graphs of FIG. 6. On the other hand, when the F orifice is made small like that shown in the solid line, the delay between the de-energization of electrical actuator 25 and the end of injection as shown by the first and sixth graphs as relatively short. Thus, the F orifice can facilitate close in time sequences of injection events, such as a main injection event followed by a close coupled post injection event with an intervening dwell time that would not be possible if the F orifice were eliminated.

Figure 7:
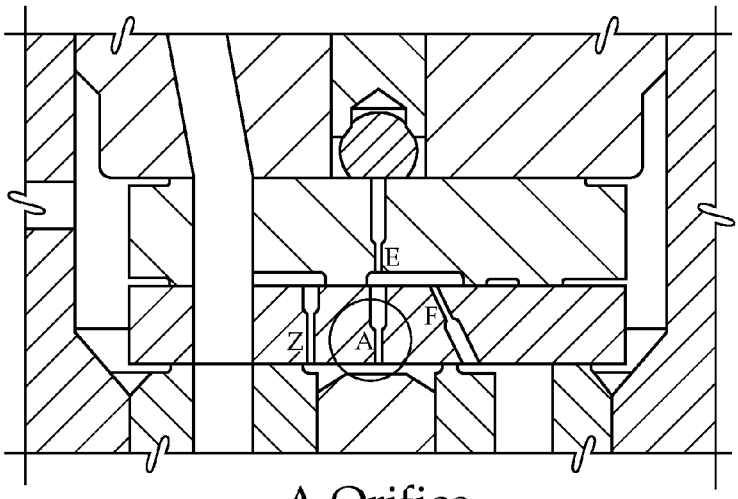
FIG. 7 is a group of strip charts similar to that of FIG. 6 showing the different performance behaviors for a relatively small and a relatively big A orifice, respectively.
Figure 7:
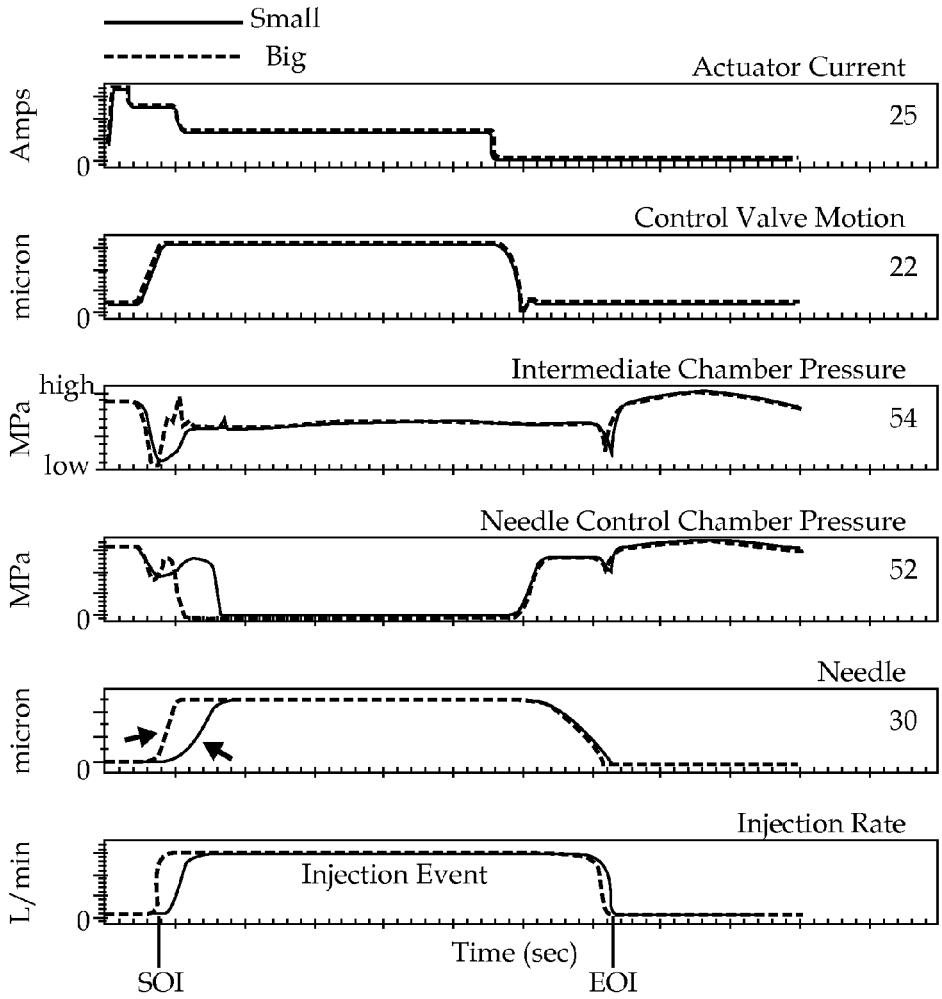

The graphs of FIG. 7 are included to illustrate a sensitivity to the size of the A orifice with the solid lines showing a small sized A orifice and a dotted line showing the injector performance for a relatively large flow area through A orifice 67. As can be seen, the size of the A orifice primarily effects injection performance at the beginning of the injection event and has little effect at the end of injection. Over many years, engineers have come to recognize that some performance improvements, may be especially relating to reducing undesirable emissions, can be achieved by a slower build up of injection rate rather than an injection rate that goes from zero almost instantaneously to maximum injection rate, as shown by the dotted line when the A orifice is large. In other words, as the flow area through the A orifice is reduced, the ability of pressure to drop in needle control chamber 52 at the beginning of an injection event is hindered, thus slowing the lifting rate of the needle valve member 30 and producing a more gradual rise in front end injection rate as shown in the fifth and sixth graphs of FIG. 7. As the flow area through orifice A becomes larger and larger, the start of injection rate shape becomes nearly vertical.

Figure 8:
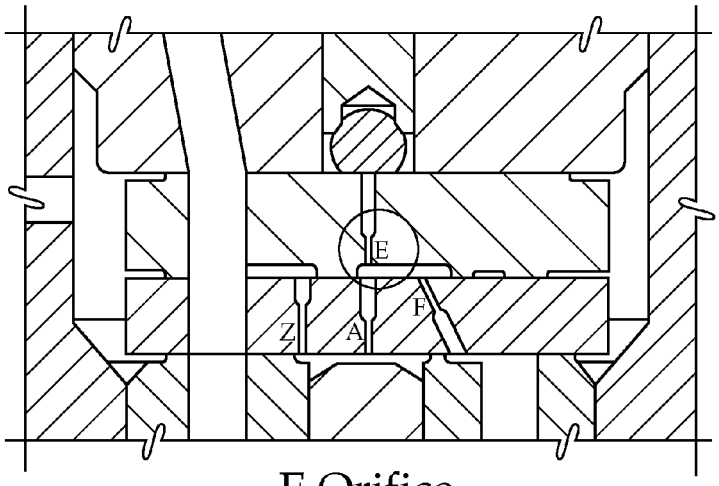
FIG. 8 is a group of strip charts similar to that of FIGS. 6 and 7 showing the different performance characteristics for an E orifice that is big and small, respectively.
Figure 8:
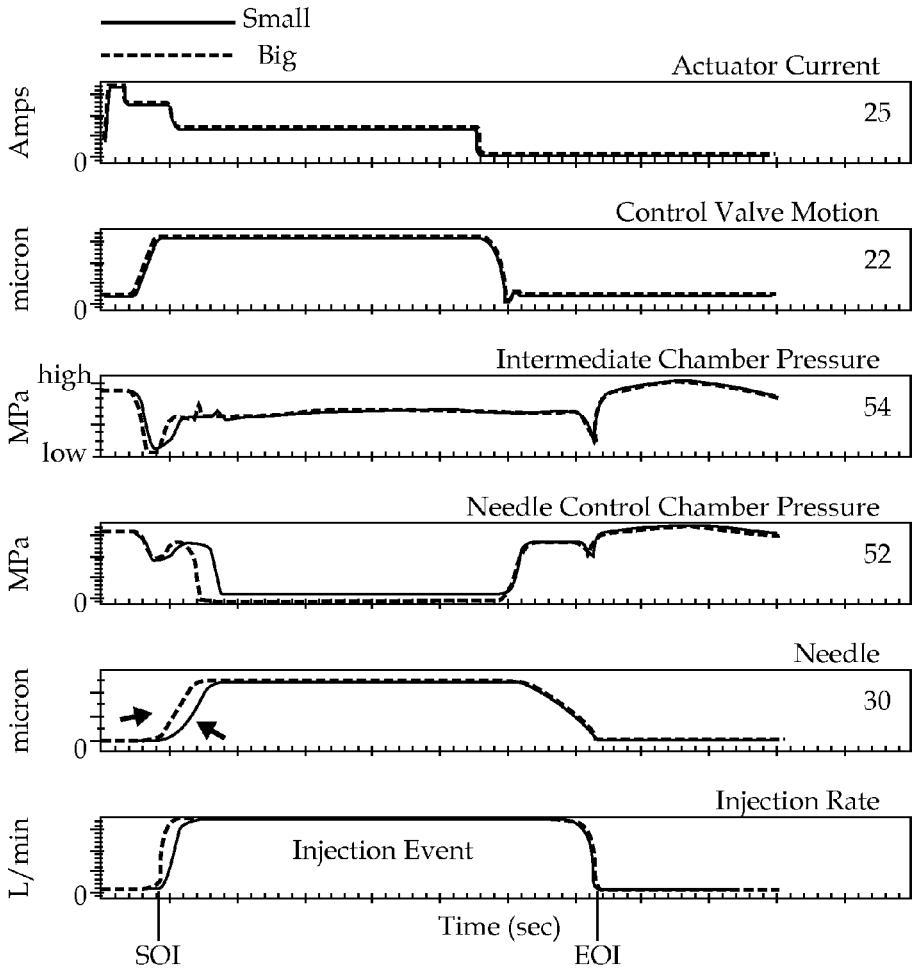

Referring to FIG. 8, the E orifice can work together with the F orifice to slow the start of injection rate shape as shown by the fifth and sixth graphs of FIG. 8. It is believed that this occurs by fuel entering the intermediate chamber 54 through the F orifice hindering the flow of fuel into the intermediate chamber 54 from the needle control chamber 52 through the A orifice, thus slowing the lifting rate of needle valve member 30 (graph 5) and slowing the initial build up of injection rate at the start of injection as shown in the sixth graph. If the E orifice is too big, the start of injection effect facilitated by the F orifice may be defeated. If the E orifice is too small, there may not be sufficient pressure drop in needle control chamber 52 to allow the needle valve member to even lift to perform an injection event at law injection pressures. The solid line and dash line graphs of FIG. 8 are intended to show the different performance effects when the E orifice is relatively big as in the solid line or relatively small as in the dashed line. As expected, the size of the E orifice as little effect on the end of injection performance characteristics as revealed by the graphs of FIG. 8.

Another subtle by important concern is the fact that, especially in the case of a common rail fuel injector, injection pressures may be substantially different engine at different operating conditions, and it may be difficult to find an E orifice flow area that produces acceptable fuel injector performance at both high and low rail pressures. Those skilled in the art will appreciate that the flow characteristics through the orifices, and hence the emergent fuel injector performance resulting therefrom, is related to the pressure gradient across the orifice, which will be different at different rail pressures. One possible starting point for selecting F, A, Z and E orifice sizes would be to set the initial flow areas as some percentage of the total flow area through nozzle outlets 45. For instance, an initial sizing on the order of 10-20% of the total flow area through the nozzle outlets 45 could be a good starting point. Next, the flow areas, the various spring pre-loads, seat diameters, etc. need to be chosen such that the fuel injector will work at the extreme high and low expected rail pressures. Next, the various orifices can be tweaked in size to achieve desired performance characteristics using, for instance, the graphs of FIGS. 6, 7 and 8 for guidance. By utilizing a two way control valve strategy in conjunction with appropriately sized F, A, Z and E orifices, injector performance characteristics can mimic and approach that of a three way valve counterpart with the added complexity and expense associated with three way valves.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A fuel injector comprising:

an injector body defining a fuel inlet, at least one nozzle outlet and a drain outlet, and having disposed therein a nozzle chamber, a needle control chamber, and an intermediate chamber;

the needle control chamber being fluidly connected to the fuel inlet by a first pathway that includes a Z orifice, and the needle control chamber being fluidly connected to the fuel inlet by a second pathway that includes an F orifice, the intermediate chamber and an A orifice;

an electronically controlled valve attached to the injector body and including a control valve member movable between a first position in contact with a seat, and a second position out of contact with the seat;

the needle control chamber being fluidly connected to the drain outlet by a third pathway that includes the A orifice, the intermediate chamber and an E orifice when the control valve member is at the second position, but the needle control chamber being blocked from the drain outlet when the control valve member is at the first position;

the seat is fluidly positioned between the E orifice and the drain outlet: and a needle valve member with an opening hydraulic surface exposed to fluid pressure in the nozzle chamber, and a closing hydraulic surface exposed to fluid pressure in the needle control chamber.

2. The fuel injector of claim 1 wherein the E orifice has a flow area smaller than a flow area defined by the seat and the control valve member at the second position.

3. The fuel injector of claim 2 wherein the seat is a flat seat; and a centerline of the needle valve member intersects an opening of the third pathway into the needle control chamber.

4. A fuel injector comprising:

an injector body defining a fuel inlet, at least one nozzle outlet and a drain outlet, and having disposed therein a nozzle chamber, a needle control chamber, and an intermediate chamber;

the needle control chamber being fluidly connected to the fuel inlet by a first pathway that includes a Z orifice, and the needle control chamber being fluidly connected to inlet by a second pathway that includes an F orifice, the intermediate chamber and an A orifice;

an electronically controlled valve attached to the injector body and including a control valve member movable between a first position in contact with a seat, and a second position out of contact with seat;

the needle control chamber being fluidly connected to the drain outlet by a third pathway that includes the A orifice, the intermediate chamber and an E orifice when the control valve member is at the second position, but the needle control chamber being blocked from the drain outlet when the control valve member is at the first position;

a needle valve member with an opening hydraulic surface exposed to fluid pressure in the nozzle chamber, and a closing hydraulic surface exposed to fluid pressure in the needle control chamber; and wherein the F orifice, the A orifice, the E orifice and the Z orifice have flow areas of a same order of magnitude.

5. The fuel injector of claim 1 wherein the F orifice, the A orifice, the Z orifice and the E orifice are each defined by one of a first disk and a second disk; and the intermediate chamber is defined by the first disk and the second disk.

6. The fuel injector of claim 5 wherein the first disk is stacked between a valve body of the electronically controlled valve and the second disk; and the second disk is stacked between the first disk and a needle guide component that defines a guide bore that receives a guide segment of the needle valve member.

7. The fuel injector of claim 6 wherein the first disk is in contact with the second disk over a plurality of non-contiguous sealing lands defined by raised surfaces on at least one of the first disk and the second disk.

8. The fuel injector of claim 1 wherein the fuel inlet is a common rail inlet that includes a conical seat;

a nozzle supply passage extends between the common rail inlet and the nozzle chamber; and the electronically controlled valve includes an electrical actuator that is the only electrical actuator of the fuel injector.

9. A fuel injector comprising:

an injector body defining a fuel inlet, at least one nozzle outlet and a drain outlet, and having disposed therein a nozzle chamber, a needle control chamber, and an intermediate chamber;

the needle control chamber being fluidly connected to the fuel inlet by a first pathway that includes a Z orifice, and the needle control chamber being fluidly connected to the fuel inlet by a second pathway that includes an F orifice, the intermediate chamber and an A orifice;

an electronically controlled valve attached to the injector body and including a control valve member removable between a first position in contact with a seat, and a second position out of contact with seat;

the needle control chamber being fluidly connected to the drain outlet by a third pathway that includes the A orifice, the intermediate chamber and an E orifice when the control value member is at the second position, but the needle control chamber being blocked from the drain outlet when the control valve member is at the first position;

a needle valve member with an opening hydraulic surface exposed to fluid pressure in the nozzle chamber, and a closing hydraulic surface exposed to fluid pressure in the needle control chamber; and wherein the E orifice is defined by a first disk;

the F orifice, the A orifice and the Z orifice are defined by a second disk; and the intermediate chamber is defined by the first disk and the second disk.

10. The fuel injector of claim 9 wherein the E orifice has a flow area smaller than a flow area defined by the seat and the control valve member at the second position.

11. The fuel injector of claim 10 wherein the seat is a flat seat; and a centerline of the needle valve member intersects an opening of the third pathway into the needle control chamber.

12. The fuel injector of claim 9 wherein the F orifice, the A orifice, the E orifice and the Z orifice have flow areas of a same order of magnitude.

13. The fuel injector of claim 12 wherein the E orifice has a flow area smaller than a flow area defined by the seat and the control valve member at the second position.

14. A method of operating a fuel injector having an injector body defining a fuel inlet, at least one nozzle outlet and a drain outlet, and having disposed therein a nozzle chamber, a needle control chamber, and an intermediate chamber; the needle control chamber being fluidly connected to the fuel inlet by a first pathway that includes a Z orifice, and the needle control chamber being fluidly connected to the fuel inlet by a second pathway that includes an F orifice, the intermediate chamber and an A orifice; an electronically controlled valve attached to the injector body and including a control valve member movable between a first position in contact with a seat, and a second position out of contact with the seat; the needle control chamber being fluidly connected to the drain outlet by a third pathway that includes the A orifice, the intermediate chamber and an E orifice when the control valve member is at the second position, but the needle control chamber being blocked from the drain outlet when the control valve member is at the first position; and a needle valve member with an opening hydraulic surface exposed to fluid pressure in the nozzle chamber, and a closing hydraulic surface exposed to fluid pressure in the needle control chamber; the method comprising the steps of:

starting an injection event;

ending the injection event;

the starting step includes moving fuel from the needle control chamber through the A orifice and from the nozzle chamber through the F orifice toward the intermediate chamber; and the starting step further includes moving fuel from the intermediate chamber toward the drain outlet through the E orifice and then past the seat after the E orifice.

15. The method of claim 14 wherein the ending step includes stopping fuel movement through the E orifice; and the ending step includes communicating pressure from the fuel inlet to the needle control chamber via the first pathway and the second pathway.

16. The method of claim 15 including a step of desensitizing a start of injection timing to variations in control valve lift by sizing the E orifice to have a flow area smaller than a flow area defined by the seat and the control valve member at the second position.

17. The method of claim 16 wherein the stopping step includes moving the control valve member to the first position in contact with a flat seat.

18. The method of claim 17 including a step of hydraulically stopping the needle valve member in an open position during an injection event.

19. A method of operating a fuel injector having an injector body defining a fuel inlet, at least one nozzle outlet and a drain outlet, and having disposed therein a nozzle chamber, a needle control chamber, and an intermediate chamber; the needle control chamber being fluidly connected to the fuel inlet by a first pathway that includes a Z orifice, and the needle control chamber being fluidly connected to the fuel inlet by a second pathway that includes an F orifice, the intermediate chamber and an A orifice; an electronically controlled valve attached to the injector body and including a control valve member movable between a first position in contact with a seat, and a second position out of contact with the seat; the needle control chamber being fluidly connected to the drain outlet by a third pathway that includes the A orifice, the intermediate chamber and an E orifice when the control valve member is at the second position, but the needle control chamber being blocked from the drain outlet when the control valve member is at the first position; and a needle valve member with an opening hydraulic surface exposed to fluid pressure in the nozzle chamber, and a closing hydraulic surface exposed to fluid pressure in the needle control chamber; the method comprising the steps of:

starting an injection event;

ending the injection event;

the starting step includes moving fuel from the needle control chamber through the A orifice and from the nozzle chamber through the F orifice toward the intermediate chamber;

the starting step further includes moving fuel from the intermediate chamber toward the drain outlet through the E orifice;

wherein the ending step includes stopping fuel movement through the E orifice;

the ending step includes communicating pressure from the fuel inlet to the needle control chamber via the first pathway and the second pathway;

desensitizing a start of injection timing to variations in control valve lift by sizing the E orifice to have a flow area smaller than a flow area defined by the seat and the control valve member at the second position;

wherein the stopping step includes moving the control valve member to the first position in contact with the flat seat;

hydraulically stopping the needle valve member in an open position during an injection event; and including a step of sealing against leakage by contacting a first disk in contact with a second disk over a plurality of non-contiguous sealing lands defined by raised surfaces on at least one of the first disk and the second disk.

20. The method of claim 19 wherein the starting step includes energizing an electrical actuator that is the only electrical actuator of the fuel injector.

* * * * *

UNITED STATES PATENT AND TRADEMARK OFFICE

CERTIFICATE OF CORRECTION

PATENT NO. : 8,448,878 B2
APPLICATION NO. : 12/941355
DATED : May 28, 2013
INVENTOR(S) : Ibrahim et al.

It is certified that error appears in the above-identified patent and that said Letters Patent is hereby corrected as shown below:

In the Specification:

Column 5, line 65, delete "Industrial Applicability" and insert -- INDUSTRIAL APPLICABILITY --.

In the Claims:

Column 8, line 39, in Claim 1, delete "outlet: and" and insert -- outlet; and --.

Column 8, lines 58-59, in Claim 4, delete "to inlet" and insert -- to the fuel inlet --.

Column 8, line 64, in Claim 4, delete "with seat;" and insert -- with the seat; --.

Column 9, line 44, in Claim 9, delete "removable" and insert -- movable --.

Column 9, line 46, in Claim 9, delete "with seat;" and insert -- with the seat; --.

Column 9, line 50, in Claim 9, delete "value" and insert -- valve --.

Column 12, lines 10-11, in Claim 19, delete "with the flat seat;" and insert -- with a flat seat; --.

Signed and Sealed this
Eleventh Day of August, 2015

Michelle K. Lee

Michelle K. Lee
*Director of the United States Patent and Trademark Office*